US005106166A

United States Patent [19]

O'Neill

[11] Patent Number: 5,106,166

[45] Date of Patent: Apr. 21, 1992

[54] CUTTING BIT HOLDING APPARATUS

[75] Inventor: Michael L. O'Neill, Lucinda, Pa.

[73] Assignee: Joy Technologies Inc., Pittsburgh, Pa.

[21] Appl. No.: 578,972

[22] Filed: Sep. 7, 1990

[51] Int. Cl.[5] ..... E21C 35/18

[52] U.S. Cl. ..... 299/86; 299/91

[58] Field of Search ..... 299/79, 80, 86, 91, 299/92, 93; 175/354, 413; 37/142 R

[56] References Cited

U.S. PATENT DOCUMENTS

| | | | |
|---|---|---|---|
| T103,602 | 11/1983 | Rettkowski | 299/10 |
| 2,429,728 | 10/1947 | McMurtry . | |
| 3,397,012 | 8/1968 | Krekeler | 299/86 |
| 3,841,708 | 10/1974 | Kniff et al. | 299/86 |
| 3,945,681 | 3/1976 | White | 299/86 |
| 4,212,559 | 7/1980 | Persson | 403/348 |
| 4,302,053 | 11/1981 | Roepke et al. | 299/86 |
| 4,462,638 | 8/1984 | DenBesten | 299/86 |
| 4,489,986 | 12/1984 | Dziak | 299/86 |
| 4,727,664 | 3/1988 | Hemphill | 37/142 R |
| 4,915,454 | 4/1990 | Southern | 299/80 |

*Primary Examiner*—David J. Bagnell
*Attorney, Agent, or Firm*—Kirkpatrick & Lockhart

[57] ABSTRACT

A mining bit holding system is provided which includes a bit holder which attaches to the rotatable drum of a mining machine. The bit holder includes a base portion and a body portion. The body portion has an aperture therethrough to receive a coaxial sleeve. The sleeve has a bore therethrough for rotatably receiving a cutting bit. The sleeve and bit holder are constructed such that the angular position of the sleeve may be fixed relative to the common axis of the aperture in the sleeve in any one of a plurality of discrete positions. Additionally, the sleeve and bit holder are constructed such that the sleeve may be rotated with respect to the axis of the aperture the body portion to another position and then fixed in that position.

3 Claims, 4 Drawing Sheets

CUTTING BIT HOLDING APPARATUS

BACKGROUND OF THE INVENTION

1. Field of the Invention

The present invention relates to holders for cutting bits used on mining machinery and, in particular, to miner bit holders which include a bit holder attached to a rotating cutting drum and an indexible sleeve for receiving a rotatable cutting bit.

2. Description of the Invention Background

In the materials mining industry, as well as in other applications requiring the cutting of hard materials, it is typical to employ an apparatus which includes a vertically moveable rotating cutting drum which has cutting bits attached thereto. By virtue of the rotation of the cutting drum and the movement of the apparatus into the material to be cut the material is removed for further processing.

It is well known that such cutting bits and their holders are subjected to considerable stresses during the mining operation. Such stresses occur axially, vertically and transverse relative to the cutting bit. Accordingly, in normal mining operations, cutting bits require frequent replacement due to wear or breakage. In fact, cutting bits must often be replaced on a daily basis. In view of these conditions, much effort has heretofore been directed to the provision of readily replaceable cutting bits which may be removed with a minimum of effort from their supports.

Because the bit holding devices are not the primary vehicles by which material is removed from the mine face, the bit holding devices are generally characterized by a longer service life. As such, bit holding systems have been developed which include a bit holder which physically retains the cutting bit and which may be mounted on the miner's cutting drum. Nevertheless, the bit holders themselves are subject to considerable wear and breakage and may require replacement on two to six month intervals.

Replacement of the bit holder can result in considerable expense and down time for the mining machinery. Therefore, bit holding devices have been developed which include a replaceable sleeve disposed between the bit holder and the cutting bit. The use of these sleeves extends the life of the bit holders by limiting the wear to which the bit holder is subjected. In the past, sleeves have been either freely rotatable within the bit holder, or they have been fixed in one position relative to the bit holder depending upon the application. The sleeve of the rotatable type has a longer service life due to even wearing on surfaces which contact the mine face. However, rotatable sleeves wear the bit holders in which they rotate. Therefore, with mining bit holders in the past, one had to make a choice between rotatable sleeves which, although they enjoy a long service life, cause excessive wear of the bit holder, and non-rotatable sleeves, which do not wear the bit holder as quickly, but must be replaced more often due to their wearing.

Reference is made to my copending application Ser. No. 578,908, filed on the same date as the present application, entitled "Apparatus for Holding a Cutting Bit", which is directed to analogous concerns as this application and whose disclosure is hereby incorporated herein by reference.

Therefore, the need exists for a non-rotatable sleeve which will not cause excessive wear of the bit holder but which can be rotated manually and fixed in one of a number of positions to extend its service life.

SUMMARY OF THE INVENTION

The present invention is directed to a mining bit holding system which includes a bit holder which attaches to the rotatable drum or cutting element of a mining machine. The bit holder includes a base portion and a body portion. The body portion has an aperture therethrough to receive a sleeve. The sleeve is of unitary construction and includes a body member and a collar at one end of the body member. The sleeve has a bore therethrough for rotatably receiving a cutting bit having an extended shank portion.

The sleeve and bit holder are constructed such that the angular position of the sleeve may be fixed with respect to the body portion in any one of a plurality of discrete positions about a common axis, namely the bore in the body portion. Additionally, the sleeve and bit holder are constructed such that the sleeve may be rotated with respect to the body portion to another position and then fixed in that position.

In one embodiment, a collar on the sleeve has a plurality of index holes therethrough. The contact face of the bit holder has a corresponding index pin. When the index hole is engaged by the index pin, the collar cannot rotate. To rotate the sleeve, the sleeve is pulled away from the body portion so that the index pin is free from the index hole. The sleeve is then rotated so that a second index hole may receive the index pin and fix the position of the sleeve relative to the axis of the bore in the bit holder.

In another embodiment, the collar has a plurality of index flats. The body portion has a corresponding fixation surface which engages one of the index flats to prevent rotation of the sleeve. The sleeve is rotated by pulling the sleeve away from the body portion so that the index flat is free from the fixation surface. The sleeve may then be rotated so that another index flat is in line with the fixation surface, and reinserted into the aperture.

In yet another embodiment, the body member of the sleeve has a plurality of cross pin grooves adjacent the end of the sleeve opposite the collar. The body portion of the bit holder includes a cross pin hole. When the cross pin hole is aligned with one of the cross pin grooves, a cross pin is inserted through the cross pin hole and cross pin groove to fix the position of the sleeve. To rotate the sleeve, the cross pin is removed and the sleeve is rotated until another one of the cross pin grooves aligns with the cross pin hole. The cross pin is then reinserted to fix the sleeve in this position.

In still another embodiment, the body member of the sleeve is polygonal in cross section. The aperture in the body portion of the bit holder has a corresponding cross section such that the aperture may receive the body member. The sleeve can thus be inserted into the aperture in a number of discrete angular positions about the common axis depending on the particular cross section that is chosen.

Accordingly, the present invention provides solutions to the aforementioned problems with miner bit holding apparatuses. As such, this invention provides a cutting bit holder and sleeve which allow the sleeve to be fixed in place with respect to the bit holder and which allows the sleeve to be rotated and then fixed in another angular position with respect to its axis which is common to that of the bore in the bit holder.

These and other details, objects and advantages of the present invention will become apparent as the following description of the preferred embodiment thereof proceeds.

DESCRIPTION OF THE DRAWINGS

In the accompanying drawings, I have shown a present preferred embodiment of the invention wherein.

DETAILED DESCRIPTION OF THE PREFERRED EMBODIMENTS

Figure 1:
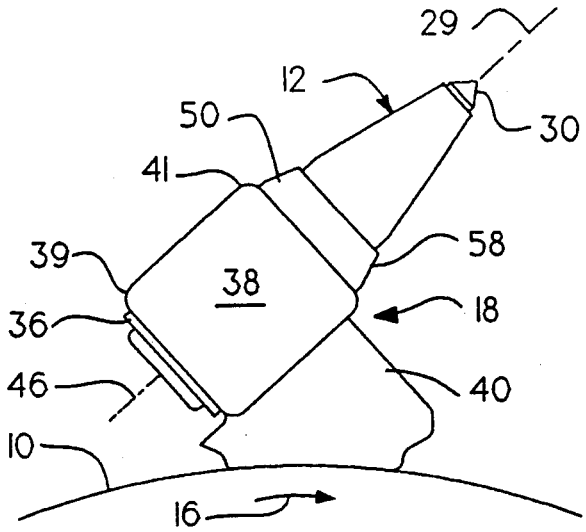
FIG. 1 is a side elevation view of the cutting bit holding apparatus according to the present invention.

Referring now to the drawings wherein the showings are for purposes of illustrating the present preferred embodiments of the invention only and not for purposes of limiting same, the Figures show a mining machine cutting drum 10 which supports a cutting bit 12 by means of a bit holder 18.

More particularly and with reference to FIG. 1, there is depicted the cutting drum 10 of a mining machine which is supported thereby for rotation in the direction shown by the arrow 16. As is well known in the art, the cutting drum 10 is supported by the mining machine for rotation while being vertically moveable and while the mining machine advances from left to right as shown in FIG. 1. As is also well known, the cutting drum 10 typically includes a plurality of cutting bits 12 arranged thereon; however, the present description will now be directed to a single cutting bit 12 and the structure of a single present bit holder 18.

Generally speaking, the bit holder 18 may be attached directly or indirectly to the drum 10. As described hereinafter, the bit holder 18 receives and retains the sleeve 50.

The cutting bit 12 may be of a previously established design including a central cylindrical shank portion 24 having an enlarged conical nose 26 attached thereto such that a shoulder area 28 is formed therebetween. The cutting bit has a central axis shown at 29 with a hard cutting tip 30 on one end of the cutting bit 12 of a material and in a manner known in the art. The cutting bit 12 includes on its other end a recessed notch 32 and terminates in an end shoulder 34 such that a retaining ring (not shown) may be received within the notch 32 to prevent the axial removal of the cutting bit 12.

Figure 2:
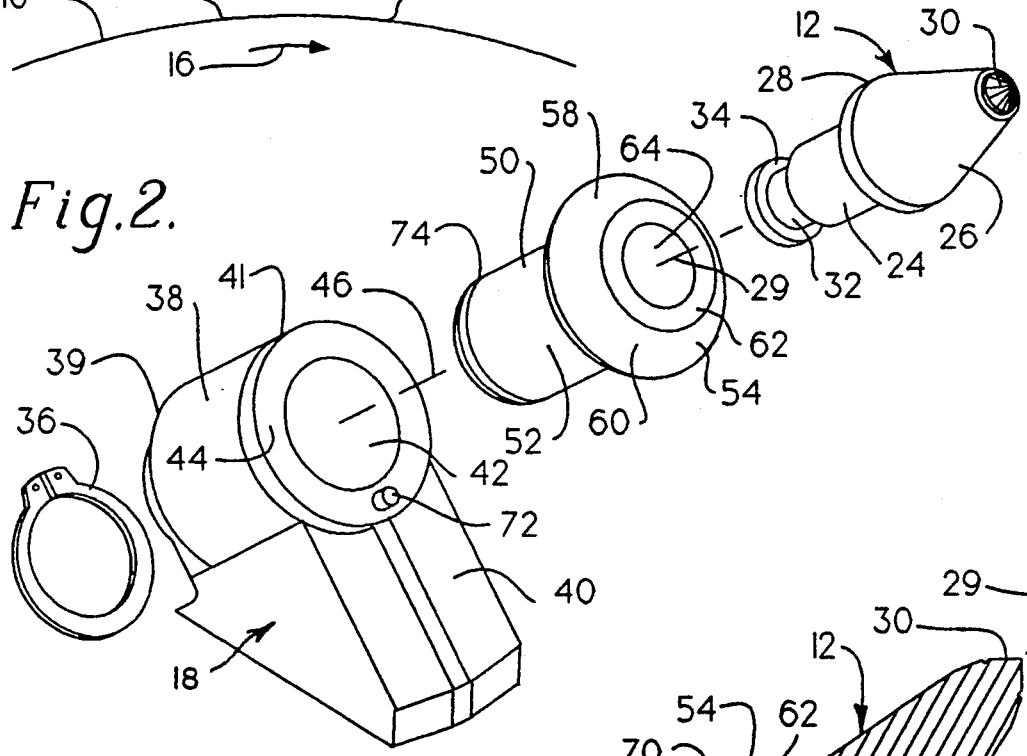
FIG. 2 is an exploded perspective view of one embodiment of the bit holding apparatus according to the present invention.
Figure 3:
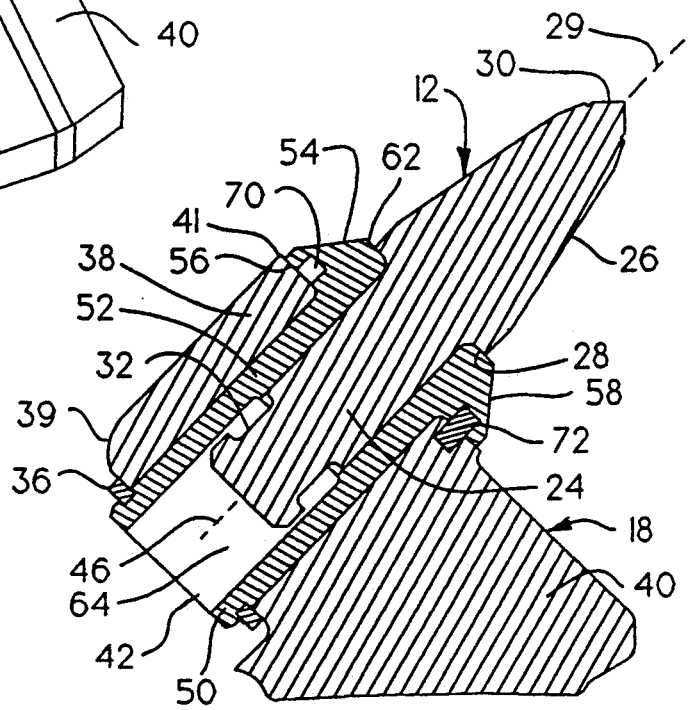
FIG. 3 is a cross sectional view of the bit holding apparatus of FIG. 2.

In one embodiment, as seen in FIGS. 2 and 3, the bit holder 18 has a body portion 38 and a base portion 40. The base portion 40 attaches directly to the cutting drum 10 by welding or clamping, or indirectly by means of a mounting block (not shown). The body portion 38, which is integral to the base portion 40, includes an aperture 42 for receiving a sleeve 50. The body portion has two ends, a trailing end 39 which faces away from the direction of rotation and the leading end 41 which faces toward the direction of rotation. The body portion 38 includes a contact face 44 which is preferably perpendicular to the longitudinal axis 46 of the aperture 42, but which may be formed as a cone whose surface is at an acute angle relative to the axis 46. The axis 46 is coaxial with the axis 29.

The sleeve 50 has a body member or shank 52 which is coaxial with axis 46 and a collar 54 with an inside surface 56 and an outside surface 58. The inside surface 56 of the collar 54 forms a shoulder corresponding to the contact face 44 which abuts the contact face 44. A retaining groove 74 is located at the end of the sleeve 50 opposite the collar 54. When the sleeve 50 is inserted into the bore 42, a retaining ring 36 locks the sleeve 50 in place, thereby preventing its axial removal. The outside surface 58 of the collar 54 has a beveled surface 60 and a flat surface 62.

The body member 52 has a bore 64 which is coaxial with axis 46. The bit 12 is rotatably received by the bore 64 as the outside diameter of the shank 24 of the bit 12 is slightly smaller than the inside diameter of the bore 64. The bore 64 therefore retains the shank 24 while allowing it to rotate about the central axis 29 in order to avoid uneven wearing of the tip 30 and the nose 26 of the cutting bit 12. The shoulder area 28 of the bit 12 abuts the flat surface 62 to position the bit 12 axially in the bore 64 and transmit cutting forces to the sleeve 50.

The collar 54 has a plurality of index holes 70 therethrough which are generally parallel to the central axis 29 of the cutting bit 12. Additionally, the contact face 44 has an index pin 72 of slightly smaller diameter than the index holes 70. The sleeve 50 is inserted into the aperture 42 so that the index pin 72 is received by one index hole 70. The sleeve 50 is thus prevented from rotating within the body portion 38. In order to rotate the sleeve 50, the retaining ring 36 is removed and the sleeve 50 is pulled away from the body portion 38 so that the index pin 72 is free from the index hole 70. The sleeve 50 is then rotated about the axis 46 and reinserted into the aperture 42 so that a another index hole 70 may receive the index pin 72. Accordingly, the sleeve 50 is then prevented from rotation.

Figure 4:
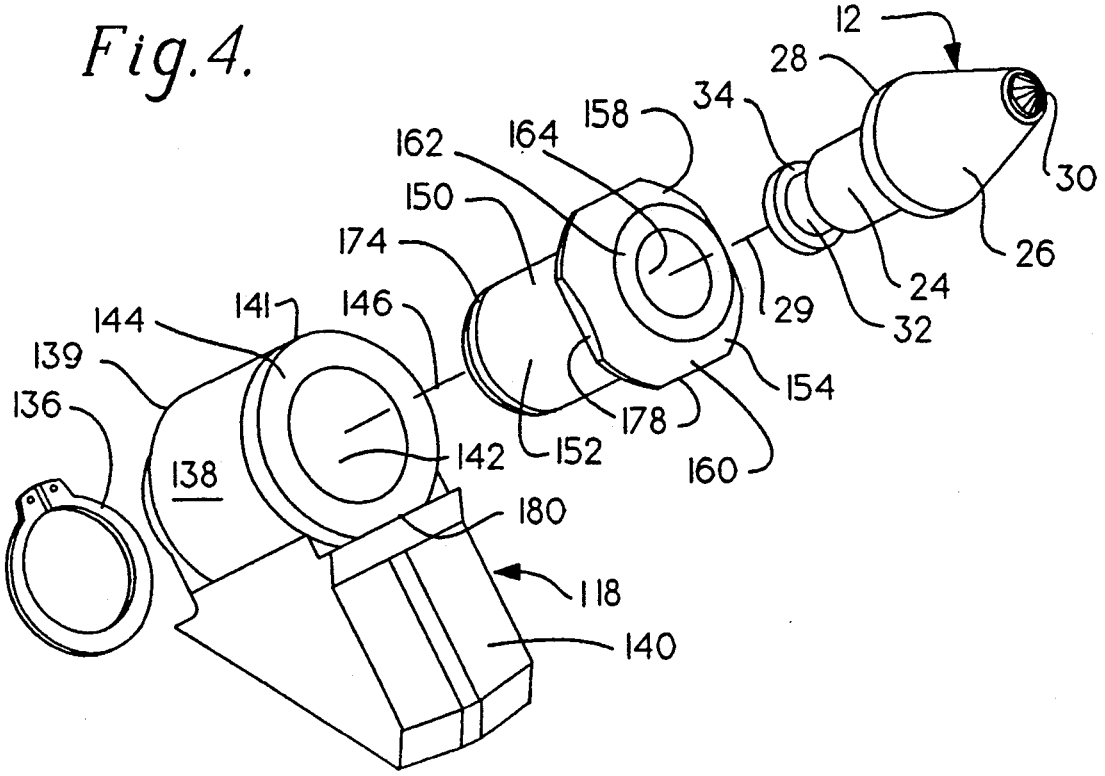
FIG. 4 is an exploded perspective view of another embodiment of the bit holder according to the present invention.
Figure 5:
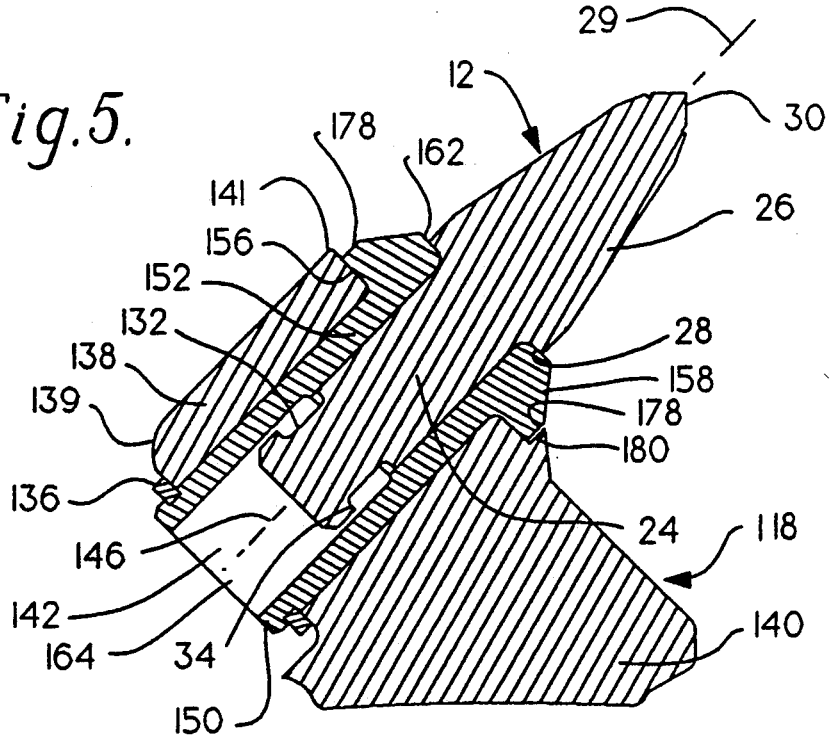
FIG. 5 is a cross sectional view of the bit holding apparatus of FIG. 4.

In another embodiment, as seen in FIGS. 4 and 5, where like elements have the same numerals as the embodiment shown in FIGS. 2 and 3 and where analogous elements have similar numerals but increased by 100, the bit holder 118 has a body portion 138 and a base portion 140. The base portion 140 attaches directly to the cutting drum 10 or indirectly by means of a mounting block (not shown). The body portion 138, which is integral to the base portion 140, includes an aperture 142 for receiving a sleeve 150. The body portion 138 has two ends, a trailing end 139 which faces away from the direction of rotation of the cutting drum and the leading end 141 which faces toward the direction of rotation. The body portion 138 includes a contact face 144 which is preferably perpendicular to the longitudinal axis 146 of the aperture 142, but which may be formed as a cone whose surface is at an acute angle relative to the axis 146, which itself is coaxial with the bit axis 29.

The sleeve 150 has a body member or shank 152 which is coaxial with axis 146 and a collar 154 with an inside surface 156 and an outside surface 158. The inside surface 156 of the collar 154 forms a shoulder corresponding to the contact face 144 which abuts the contact face 144. A retaining groove 174 is located at the end of the sleeve 150 opposite the collar 154. When the sleeve 150 is inserted into the aperture 142, a retaining ring 136 locks the sleeve 150 in place, thereby preventing its axial removal. The outside surface 158 of the collar 154 has a beveled surface 160 and a flat surface 162.

The body member 152 has a bore 164 which is coaxial with axis 146. The bit 12 is rotatably received by the bore 164. The shank 24 of the bit 12 is slightly smaller than the bore 164. The bore 164 therefore retains the shank 24 while allowing it to rotate about the central axis 29 in order to avoid uneven wearing of the tip 30 of the cutting bit 12. The shoulder area 28 of the bit 12 abuts the flat surface 162 to position the bit 12 axially in the bore 164 and transmit cutting forces.

The collar 154 has a plurality of index flats 178. The base portion 140 has a fixation surface 180 adjacent the contact face 144. The sleeve 150 is inserted into the aperture 142 so that one of the index flats 178 is in line with the fixation surface 180. The sleeve 150 is rotated about the axis 146 by removing the retaining clip 136 and pulling the sleeve 150 away from the body portion 138 so that the fixation surface 180 will not interfere with the rotation of the sleeve 150. A second index flat 178 is then aligned with the fixation surface 180 and the sleeve 150 is then reinserted into the aperture 142 to prevent rotation of the sleeve 150.

Figure 6:
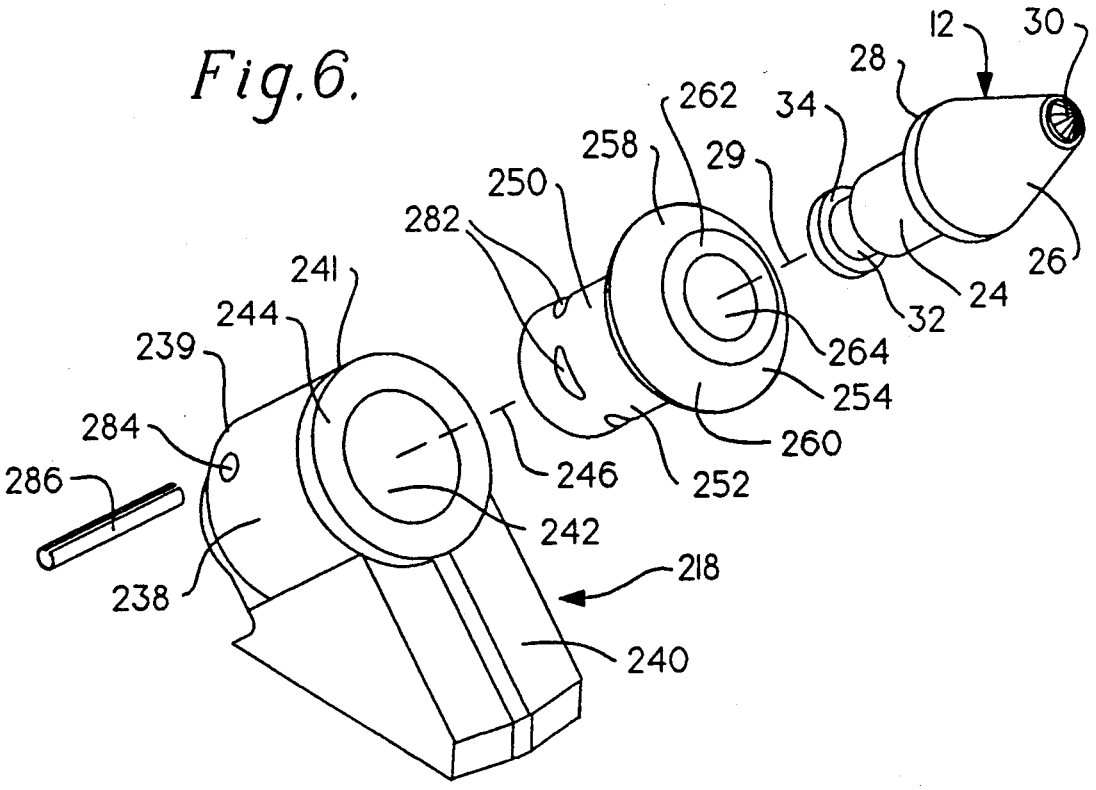
FIG. 6 is an exploded perspective view of another embodiment of the bit holder according to the present invention.
Figure 7:
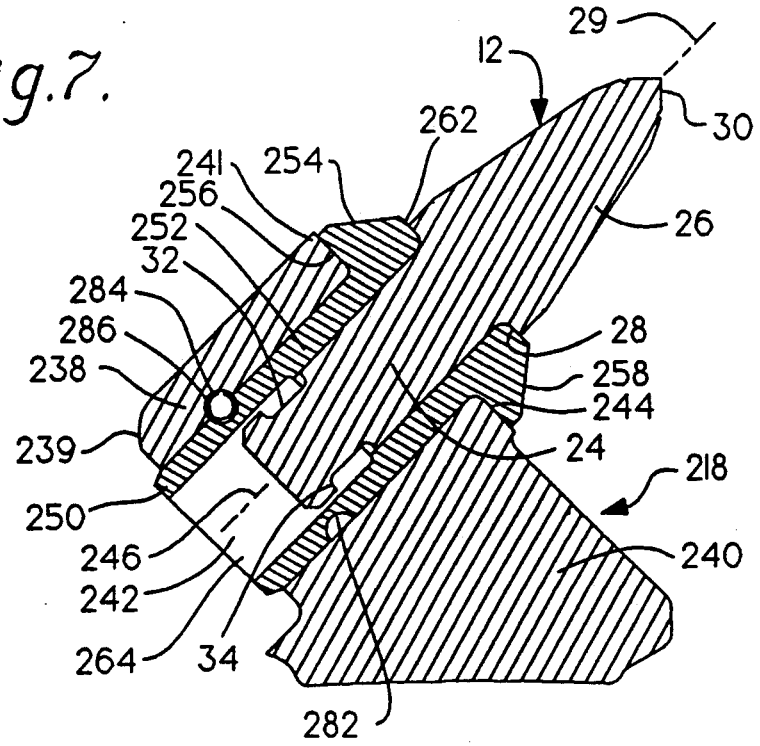
FIG. 7 is a cross sectional view of the bit holding apparatus of FIG. 6.

In another embodiment, as seen in FIGS. 6 and 7, wherein again like numerals depict like elements in FIGS. 2 and 3 and where analogous elements have similar numerals but now increased by 200, the bit holder 218 has a body portion 238 and a base portion 240. The base portion 240 attaches directly to the cutting drum 10 or indirectly by means of a mounting block (not shown). The body portion 238, which is integral to the base portion 240, includes an aperture 242 for receiving a sleeve 250. The body portion has two ends, a trailing end 239 which faces away from the direction of rotation and the leading end 241 which faces toward the direction of rotation. The body portion 238 includes a contact face 244 which is preferably perpendicular to the longitudinal axis 246 of the aperture 242, but which may be formed as a cone whose surface is at an acute angle relative to the axis 246, which itself is coaxial with the bit axis 29.

The sleeve 250 has a body member or shank 252 which is coaxial with axis 246 and a collar 254 with an inside surface 256 and an outside surface 258. The inside surface 256 of the collar 254 forms a shoulder corresponding to the contact face 244 and abuts the contact face 244. The outside surface 258 of the collar 254 has a beveled surface 260 and a flat surface 262.

The body member 252 has a bore 264 which is coaxial with axis 246. The bit 12 is rotatably received by the bore 264. The shank 24 of the bit 12 is slightly smaller than the bore 264. The bore 264 therefore retains the shank 24 while allowing it to rotate about the central axis 29 in order to avoid uneven wearing of the tip 30 of the cutting bit 12. The shoulder area 28 of the bit 12 abuts the flat surface 262 to position the bit 12 axially in the bore 264 and transmit cutting forces.

The body member 252 of the sleeve 250 has a plurality of transverse cross pin grooves 282 adjacent the end opposite the collar 254. The cross pin grooves 282 have an axis which is perpendicular to axis 246 and form a tangent to the body member 252. The body portion 238 of the bit holder 18 includes a cross pin hole 284 adjacent the end opposite the contact face 244 and which is transverse to axis 246. The sleeve 250 is inserted into the aperture 242 so that the cross pin hole 284 is coaxially aligned with the cross pin groove 282. A cross pin 286 is inserted into the cross pin hole 284. Rotation of the sleeve 250 is thereby prevented. In this embodiment, no retaining ring is necessary because axial movement of the sleeve 250 is prevented due to restrainment by the cross pin 286. When rotation of the sleeve 250 is desired, the cross pin 286 is removed. The sleeve 250 can then be rotated about axis 246 until another cross pin groove 282 is aligned with the cross pin hole 284. The cross pin 286 can then be inserted into the cross pin hole 284 to prevent rotation of the sleeve 250.

Figure 8:
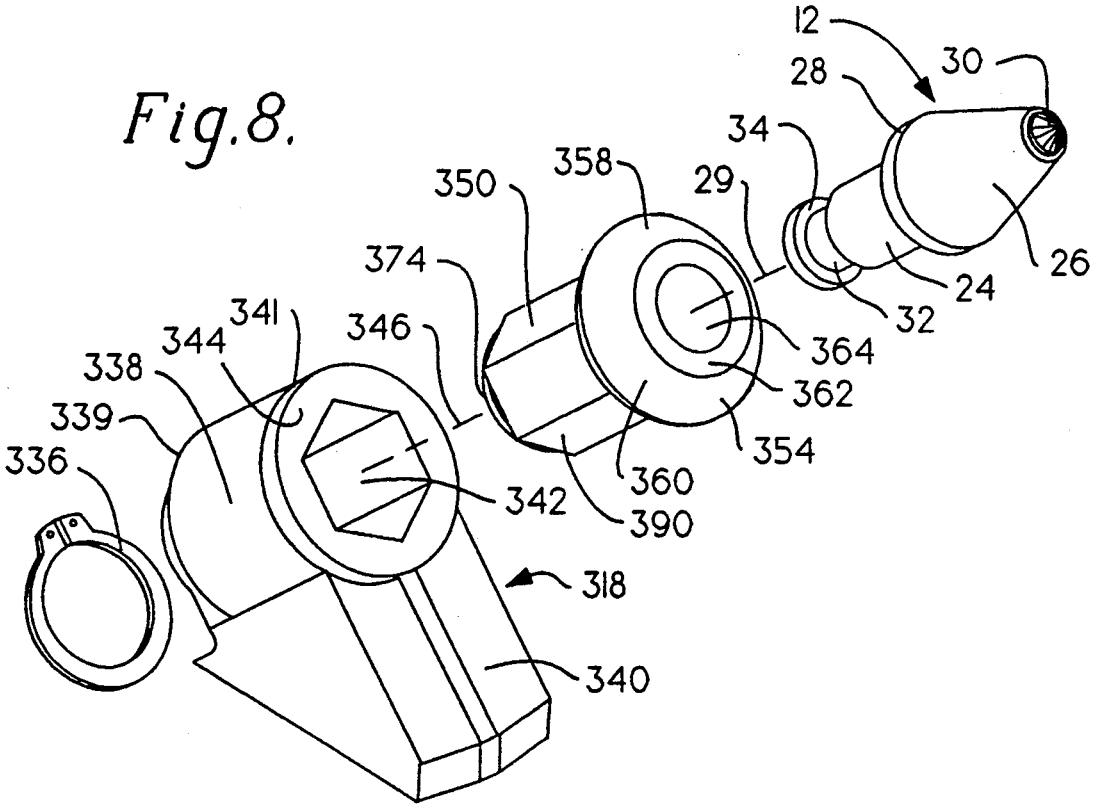
FIG. 8 is an exploded perspective view of another embodiment of the bit holder according to the present invention.
Figure 9:
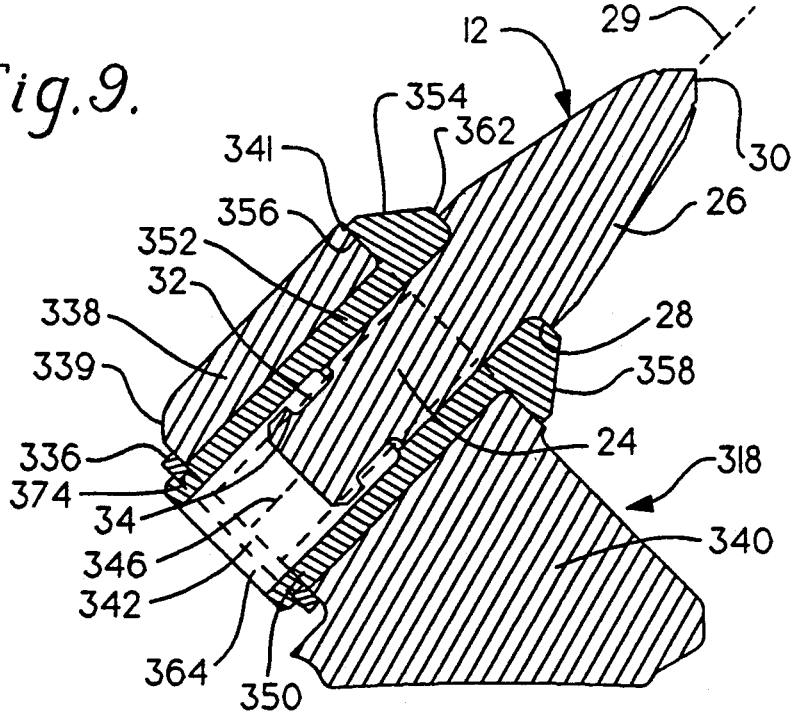
FIG. 9 is a cross sectional view of the bit holding apparatus of FIG. 8.

In another embodiment, as seen in FIGS. 8 and 9, wherein like numerals again depict like elements in FIGS. 2 and 3 and where analogous elements have similar numerals but increased by 300, the bit holder 318 has a body portion 338 and a base portion 340. The base portion 340 attaches directly to the cutting drum 10 or indirectly by means of a mounting block (not shown). The body portion 338, which is integral to the base portion 340, includes an aperture 342 for receiving a sleeve 350. The body portion has two ends, a trailing end 339 which faces away from the direction of rotation and the leading end 341 which faces toward the direction of rotation. The body portion 338 includes a contact face 344 which is preferably perpendicular to the longitudinal axis 346 of the aperture 342, but which may be formed as a cone whose surface is at an acute angle to the axis 346, which itself is coaxial with the bit axis 29.

The sleeve 350 has a body member or shank 352 which is coaxial with axis 346 and a collar 354 with an inside surface 356 and an outside surface 358. The inside surface 356 of the collar 354 forms a shoulder corresponding to the contact face 344 which abuts the contact face 344. A retaining groove 374 is located at the end of the sleeve 350 opposite the collar 354. When the sleeve 350 is inserted into the aperture 342, a retaining ring 336 locks the sleeve 350 in place, thereby preventing its axial removal. The outside surface 358 of the collar 354 has a beveled surface 360 and a flat surface 362.

The body member 352 has a bore 364 which is coaxial with axis 346. The bit 12 is rotatably received by the bore 364. The shank 24 of the bit 12 is slightly smaller than the bore 364. The bore 364 therefore retains the shank 24 while allowing it to rotate about the central axis in order to avoid uneven wearing of the tip 30 of the cutting bit 12. The shoulder area 28 of the bit 12 abuts the flat surface 362 to position the bit 12 axially in the bore 364 and transmit cutting forces.

The body member 352 of the sleeve 350 is noncircular in cross section having a plurality of flat sides 390. The cross section, as shown, is hexagonal but it may be any symmetrical polygon such as square or octagonal, for example. The aperture 342 has a corresponding cross section of slightly larger size. The sleeve 350 can thus be inserted into the aperture 342. The sleeve is thereby prevented from rotating within the aperture 342. To rotate the sleeve 350 to a different angular position about axis 346, it is pulled out of the aperture 342 and reinserted in a different position. Thereafter the sleeve 350 is locked against axial removal by clip 336.

It will be understood that various changes in the details, materials and arrangements of parts which have been herein described and illustrated in order to explain the nature of the invention, may be made by those skilled in the art within the principle and scope of the invention expressed in the appended claims.

What is claimed is:

1. Apparatus for supporting a cutting bit having an elongated shank and a shoulder disposed adjacent to a cutting tip, on a cutting element which is moveable in a cutting direction, comprising:

a bit holder having a base portion and a body portion, said base portion constructed for attachment to said cutting element, said body portion having a trailing end facing away from the cutting direction and a leading end facing in the cutting direction, said body portion further having an aperture therein coaxial with the cutting bit and extending from said trailing end to said leading end and a contact face at said leading end;

a sleeve member coaxial with the axis of the cutting bit and having a body member and a collar located at one end of said sleeve member, said body member constructed to be received by said aperture in said leading end of said body portion, said collar having an inside surface and an outside surface, said inside surface adapted for engagement with said contact face, said sleeve member further having a bore therethrough for rotatably receiving the shank of the cutting bit such that the shoulder engages said outside surface of said collar; and means for releasably fixing the angular axial position of said sleeve member relative to the aperture in said body portion about their common axis in one of a plurality of discrete angular axial positions so that said sleeve member may be released from said body portion and fixed in another of said plurality of discrete positions, said means for releasably fixing the angular axial position of said sleeve comprising a plurality of holes in said collar and a corresponding pin on said contact face of said body portion constructed to be received by one of said holes.

2. Apparatus for supporting a cutting bit having an elongated shank and a shoulder disposed adjacent to a cutting tip, on a cutting element which is moveable in a cutting direction, comprising:

a bit holder having a base portion and a body portion, said base portion constructed for attachment to said cutting element, said body portion having a trailing end facing away from the cutting direction and a leading end facing in the cutting direction, said body portion further having an aperture therein coaxial with the cutting bit and extending from said trailing end to said leading end and a contact face at sad leading end;

a sleeve member coaxial with the axis of the cutting bit and having a body member and a collar located at one end of said sleeve member, said body member constructed to be received by said aperture in said leading end of said body portion, said collar having an inside surface and an outside surface, said inside surface adapted for engagement with said contact face, said sleeve member further having a bore therethrough for rotatably receiving the shank of the cutting bit such that the shoulder engages said outside surface of said collar; and means for releasably fixing the angular axial position of said sleeve member relative to the aperture in said body portion about their common axis in one of a plurality of discrete angular axial positions so that said sleeve member may be released form said body portion and fixed in another of said plurality of discrete positions, said means for releasably fixing the angular axial position of said sleeve comprising a fixation surface on said body portion adjacent to said aperture and a plurality of corresponding flat surfaces on the perimeter of said collar adapted for engagement with said fixation surface.

3. Apparatus for supporting a cutting bit having an elongated shank and a shoulder disposed adjacent to a cutting tip, on a cutting element which is moveable in a cutting direction, comprising:

a bit holder having a base portion and a body portion, said base portion constructed for attachment to said cutting element, said body portion having a trailing end facing away from the cutting direction and a leading end facing in the cutting direction, said body portion further having an aperture therein coaxial with the cutting bit and extending from said trailing end to said leading end and a contact face at said leading end;

a sleeve member coaxial with the axis of the cutting bit and having a body member and a collar located at one ned of said sleeve member, said body member constructed to be received by said aperture in said leading end of said body portion, said collar having an inside surface and an outside surface, said inside surface adapted for engagement with said contact face, said sleeve member further having a bore therethrough for rotatably receiving the shank of the cutting bit such that the shoulder engages said outside surface of said collar; and means for releasably fixing the angular axial position of said sleeve member relative to the aperture in said body portion about their common axis in one of a plurality of discrete angular axial positions so that said sleeve member may be released from said body portion and fixed in another of said plurality of discrete positions, said means for releasably fixing the angular axial position of said sleeve member comprising a pin, a plurality of transverse grooves in said body member of said sleeve member and a corresponding coaxial transverse hole in said body portion for receiving said pin through one of said grooves and said hole in said body portion.

* * * * *

UNITED STATES PATENT AND TRADEMARK OFFICE

CERTIFICATE OF CORRECTION

PATENT NO. : 5,106,166

DATED : April 21, 1992

INVENTOR(S) : Michael L. O'Neill

It is certified that error appears in the above-identified patent and that said Letters Patent is hereby corrected as shown below:

On the title page, Item [56]:
In References Cited,
add --Foreign Patent Documents
2817726 10-1979 Germany
3307910 9-1984 Germany
3630443 3-1988 Germany
2137263 10-1984 Great Britain--

In the Abstract, line 13, add --in-- after the word the word "aperture".

Col. 4, line 48, delete "a".

Col. 8, line 17, delete "form" and substitute therefore --from--.

Col. 8, line 39, delete "ned" and substitute therefore --end--.

Signed and Sealed this

Second Day of November, 1993

Bruce Lehman

*Attest:*

BRUCE LEHMAN

*Attesting Officer*

*Commissioner of Patents and Trademarks*